US006923734B2

(12) United States Patent
Meyer

(10) Patent No.: US 6,923,734 B2
(45) Date of Patent: Aug. 2, 2005

(54) GOLF CLUB HEAD WITH PORTS AND WEIGHTED RODS FOR ADJUSTING WEIGHT AND CENTER OF GRAVITY

(75) Inventor: Dean E. Meyer, Oakbrook, IL (US)

(73) Assignee: Jas. D. Easton, Inc., Van Nuys, CA (US)

( * ) Notice: Subject to any disclaimer, the term of this patent is extended or adjusted under 35 U.S.C. 154(b) by 0 days.

(21) Appl. No.: 10/423,169

(22) Filed: Apr. 25, 2003

(65) Prior Publication Data

US 2004/0214658 A1 Oct. 28, 2004

(51) Int. Cl.[7] ..... A63B 53/04
(52) U.S. Cl. ..... 473/336; 473/341
(58) Field of Search ..... 473/252, 336, 473/350, 334, 335, 337, 338, 339

(56) References Cited

U.S. PATENT DOCUMENTS

| | | | | |
|---|---|---|---|---|
| 1,453,503 A | | 5/1923 | Holmes | |
| 2,328,583 A | | 9/1943 | Reach | |
| 2,332,342 A | | 10/1943 | Reach | |
| 2,460,445 A | | 2/1949 | Bigler | |
| 2,998,254 A | | 8/1961 | Rains et al. | |
| 3,680,868 A | | 8/1972 | Jacob | |
| 3,845,960 A | | 11/1974 | Thompson | |
| 3,979,122 A | | 9/1976 | Belmont | |
| 4,008,896 A | | 2/1977 | Gordos | |
| 4,145,052 A | | 3/1979 | Janssen et al. | |
| 4,180,269 A | * | 12/1979 | Thompson | 473/336 |
| 4,828,266 A | | 5/1989 | Tunstall | |
| 4,869,507 A | | 9/1989 | Sahm | |
| 4,927,144 A | | 5/1990 | Stormon | |
| 4,944,515 A | | 7/1990 | Shearer | |
| 5,013,041 A | | 5/1991 | Sun et al. | |
| 5,184,823 A | | 2/1993 | Desboilles et al. | |
| 5,193,806 A | | 3/1993 | Burkly | |
| 5,244,210 A | | 9/1993 | Au | |
| 5,407,202 A | * | 4/1995 | Igarashi | 473/342 |
| 5,447,307 A | * | 9/1995 | Antonious | 473/350 |
| 5,489,097 A | | 2/1996 | Simmons | |
| 5,501,461 A | | 3/1996 | Donofrio | |
| 5,522,593 A | * | 6/1996 | Kobayashi et al. | 473/349 |
| 5,571,053 A | | 11/1996 | Lane | |
| 5,626,530 A | | 5/1997 | Schmidt et al. | |
| 5,746,664 A | | 5/1998 | Reynolds, Jr. | |
| 5,766,091 A | | 6/1998 | Humphrey et al. | |
| 5,766,092 A | | 6/1998 | Mimeur et al. | |
| 5,792,004 A | | 8/1998 | Nagamoto | |
| 5,807,191 A | | 9/1998 | Nakahara | |
| 5,865,687 A | | 2/1999 | Alzano | |
| 5,913,735 A | | 6/1999 | Kenmi | |
| 5,947,841 A | | 9/1999 | Silvestro | |
| 6,001,024 A | | 12/1999 | Van Alen, II et al. | |
| 6,015,354 A | * | 1/2000 | Ahn et al. | 473/256 |
| 6,030,295 A | | 2/2000 | Takeda | |
| 6,042,486 A | | 3/2000 | Gallagher | |
| 6,071,200 A | * | 6/2000 | Song | 473/345 |
| 6,077,171 A | | 6/2000 | Yoneyama | |
| 6,099,414 A | | 8/2000 | Kusano et al. | |
| 6,149,533 A | | 11/2000 | Finn | |
| 6,277,032 B1 | | 8/2001 | Smith | |
| 6,299,546 B1 | | 10/2001 | Wang | |
| 6,368,230 B1 | | 4/2002 | Helmstetter et al. | |

* cited by examiner

*Primary Examiner*—Gregory Vidovich
*Assistant Examiner*—Nini F. Legesse
(74) *Attorney, Agent, or Firm*—Olson & Hierl, Ltd.

(57) ABSTRACT

A golf club head incorporating at least one interior port adapted to receive a weighted rod which is introduced into the head and the port through an opening and cavity defined in the hosel junction. The weight and density of the rod determines the location of the head center of gravity. In one embodiment, the head includes two elongate arcuate ports adapted to receive respective elongate flexible rods adapted to conform to the shape of the port. An associated tuning package allows an individual to identify and select a recommended rod combination depending upon the desired weight and center of gravity location.

12 Claims, 3 Drawing Sheets

10
66
62
43
20
28
60
24
82
48
61
16
88
76
22
26
64
70
44
90
42
80
46
88
15

10
46
22
14
48
80
16
28
15
26
61
24
82
18
62

10
16
43
82
24
15
66
88
28
90
76
88
70
26
22
42
80
64

GOLF CLUB HEAD WITH PORTS AND WEIGHTED RODS FOR ADJUSTING WEIGHT AND CENTER OF GRAVITY

FIELD OF THE INVENTION

This invention relates to golf clubs and, more particularly, to a golf club head incorporating interior ports adapted to receive weighted rods adapted to allow the adjustment of the head weight and center of gravity.

BACKGROUND OF THE INVENTION

It is well known in the art of golf and golf clubs that both the weight and the location of the center of gravity (C.G.) of a golf club head have a direct effect on the swing and driving characteristics of a golf club. It is also known that the weight and center of gravity of a golf club head may be customized to accommodate for such variables as, for example, golf ball position, golf club swing angle, golf club length, and golfer experience or handicap.

Several golf clubs have been developed with heads which allow both weight and center of gravity to be customized and adjusted. One such golf club is disclosed in, for example, U.S. Pat. No. 5,013,041 where the head defines a pair of interior ports which are accessible through an opening in the toe of the head and are adapted to receive a plurality of weight and center of gravity adjustment members. A disadvantage, however, is that the linear and adjacent, up and down relationship between the two ports provides for only a limited and narrow C.G. adjustment envelope.

It is also known that the recommended weight of a golf club head is in part dependent upon the length of the golf club shaft which in turn then also determines the optimal or preferred weight of the C.G. adjustment members. U.S. Pat. No. 5,013,041 fails to disclose any means for identifying and selecting the proper combination of weight members required to meet the recommended head weight and preferred center of gravity location.

It would thus be desirable to provide a golf club head incorporating ports and weighted rods providing a larger envelope of available center of gravity locations. It would also be desirable to provide a weight and center of gravity tuning package allowing an individual to identify and select particular weight rod combinations which will meet the recommended golf club head weight and further provide the preferred center of gravity location.

SUMMARY OF THE INVENTION

The invention is directed to a golf club head which, in one embodiment, comprises a club head body including an interior defining a pair of arcuate elongate ports positioned in the body to define a center of gravity adjustment envelope, a hosel junction unitary with the body and defining a cavity and opening therein in communication with the interior of the body and the pair of ports, and a pair of elongate plugs or rods adapted to be introduced through the opening in the hosel junction and into the pair of ports respectively. In accordance with the invention, the plugs are adapted to conform to the arcuate shape of the ports.

In one embodiment, the first and second plugs comprise elongate flexible jackets filled with weighted material and each of the rods includes an end adapted to cooperate with a tool adapted to allow the insertion and removal of the plugs from the body. Further, a shoulder formed on the plugs defines a stop limiting the travel of the plugs into the respective ports.

The invention is also directed to a package and method for tuning the weight and center of gravity of the golf club head. The package includes a container or box which houses a plurality of the first and second weighted rods and identification means such, as for example, a chart, table or the like including information adapted to allow the identification of which of the first and second rods to retrieve from the box to achieve a desired weight and center of gravity.

The method of tuning the weight and center of gravity of the golf club head includes the steps of determining the combined weight of the first and second weighted elongated rods required to achieve a recommended final weight of the head, determining a golfer's desired C.G. location, and then selecting one each of the first and second rods from the rod container having a combined weight equal to the combined weight determined above and adapted to achieve the desired center of gravity location also determined above.

Other features and advantages of the present invention will become readily apparent from the following detailed description, the appended drawings, and the accompanying claims.

BRIEF DESCRIPTION OF THE DRAWINGS

In the drawings:

FIG. 10 depicts a reference table or chart adapted for use in connection with the package according to the present invention for tuning the weight and center of gravity of the head of a golf club.

Figure 1:
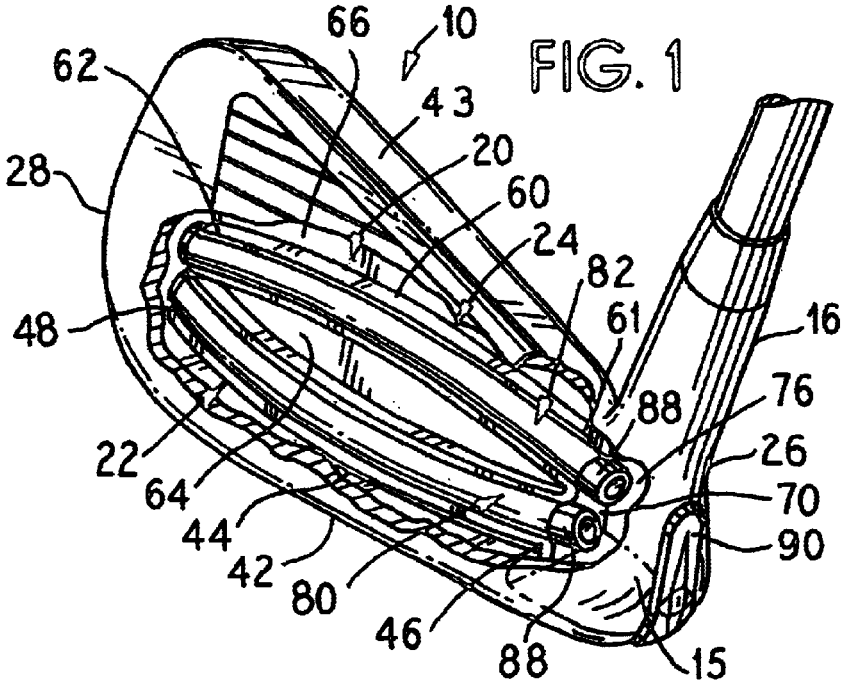
FIG. 1 is a perspective view of a golf club head in accordance with the present invention which has been broken away to show the interior ports and weight rods therein.

The invention disclosed herein is, of course, susceptible of embodiment in many different forms. Shown in the drawings and described herein below in detail is a preferred embodiment of the invention. It is to be understood, however, that the present disclosure is an exemplification of the principles of the invention and does not limit the invention to the illustrated embodiment.

For ease of description, the golf club head of the present invention is described herein below in its usual upright vertical swinging position and orientation and terms such as upper, lower, vertical, etc., will be used herein with reference to this usual orientation.

It is also understood that the FIGURES herein do not necessarily show or describe details of the golf club head that are known in the art and that will be recognized by those skilled in the art as such. The detailed descriptions of such elements are not necessary to an understanding of the invention. Accordingly, such elements are herein represented, shown, and described herein only to the degree necessary to aid in an understanding of the features of the golf club head of the present invention.

It is further understood that while the golf club head depicted in FIGS. 1–6 is that of an iron golf club, the principles of the present invention apply as well to other types of golf clubs such as drivers, wedges, and putters. Moreover, it is understood that, while the FIGURES show a head made from two separate casted plates, the invention encompasses heads made using any other techniques known in the art.

FIGS. 1–6 depict a golf club head 10 constructed in accordance with the present invention. As shown initially in FIG. 6, head 10 comprises a back member 12 comprising a stainless steel back plate 14, unitary hosel junction 15 and a hosel 16. Head 10 further comprises a separate stainless steel face or strike plate 18 which, in the embodiment shown, is adapted to be mated and affixed to the front of the back plate 14 as by welding or the like during a casting operation along the peripheral circumferential edges thereof. Plates 14 and 18 in combination define a golf club head interior body 20 and a pair of elongate interior generally arcuate and tubular chambers or ports 22 and 24 (FIGS. 1 and 4) extending substantially the full length of body 20 between the heel 26 at one end and the toe 28 at the other end.

Figure 4:
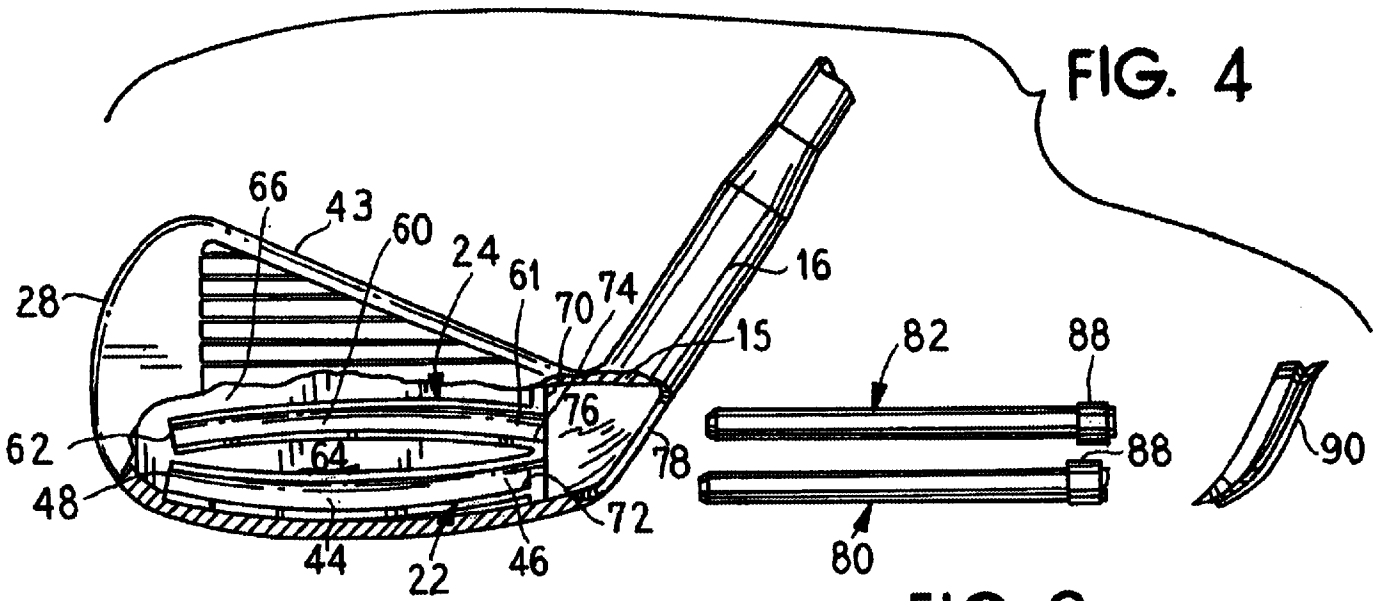
FIG. 4 is a broken, exploded, front elevational view of the golf club head of FIG. 1 with the weight rods removed therefrom.
Figure 6:
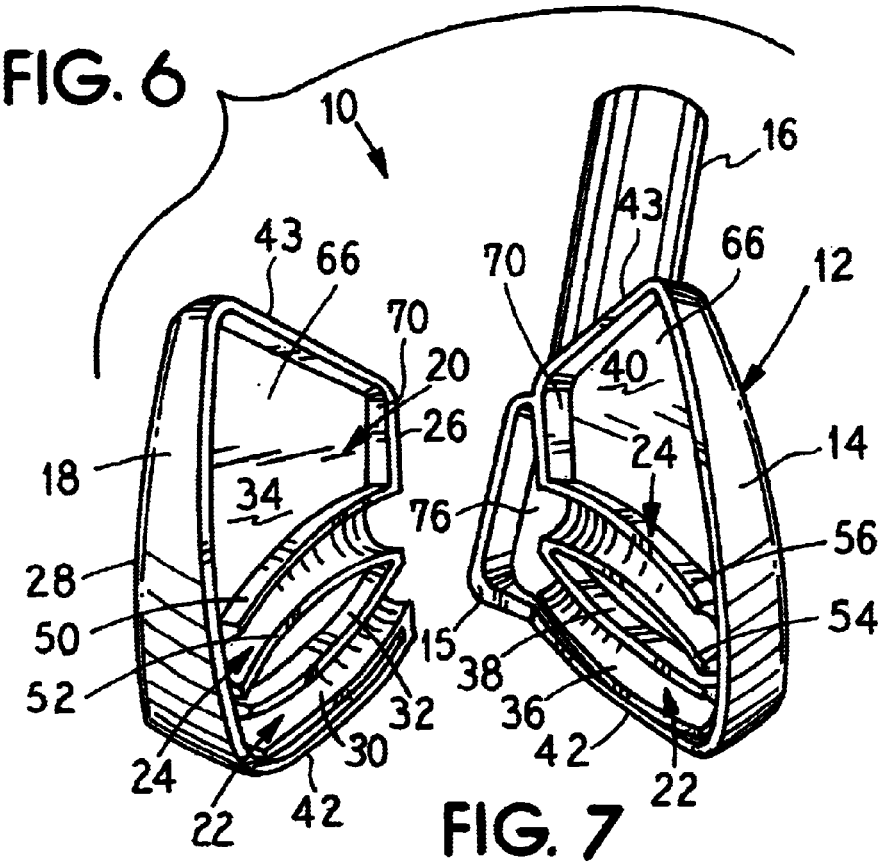
FIG. 6 is a perspective view of the two golf club head sections forming the golf club head of FIG. 1.

Particularly, and referring to FIGS. 4 and 6 in combination, chamber or port 22 is defined by spaced-apart arcuate and parallel walls 30 and 32 extending unitarily outwardly from the interior face 34 of plate 18 and adapted to cooperate and mate with walls 36 and 38 extending outwardly from the interior face 40 of plate 14 when the two halves of the head 10 are brought together and welded during the manufacturing operation. The lower mating walls 32 and 36 of the chamber 22 extend longitudinally between the heel 26 and the toe 28 in a relationship generally adjacent the elongate, longitudinally extending bottom sole plate 42 of head 10. The respective walls 30, 32, 34 and 36 define an arcuate chamber mid-portion or segment 44 and opposed unitary chamber end portions or segments 46 and 48 which arc (i.e., curve) and extend generally outwardly and upwardly away from the sole plate 42 in the longitudinal (horizontal or X axis) heel to toe direction and the transverse (vertical or Y axis) sole plate to top face direction, respectively. The curve or arc of chamber 22 and the walls defining the same corresponds generally to the curve or arc of the sole plate 42.

Chamber 24, in turn, is defined by spaced-apart, arcuate and parallel spaced-apart walls 50 and 52 extending unitarily outwardly from the interior face 34 of plate 18 which cooperate and mate with spaced-apart arcuate and parallel walls 54 and 56 formed on and extending outwardly from the interior face 40 of plate 14. The curve or arc of the chamber 24 and the walls defining the same mirrors the curve or arc of the chamber 22. As with the chamber 22, the respective walls 50, 52, 54 and 56 of chamber 24 define an arcuate chamber mid-portion or segment 60 and opposed unitary chamber end portions or segments 61 and 62.

As shown in the embodiment of FIGS. 1 and 4, chambers 22 and 24 are thus positioned and oriented relative to each other in the interior of body 20 in a diametrically opposed mirrored relationship wherein mid-segment or portion 60 of chamber 24 is spaced from the mid-segment or portion 44 of chamber 22 and the opposed end segments 61 and 62 of chamber 24 curve or arc outwardly and downwardly (in the longitudinal and transverse head directions respectively) into a generally adjacent and abutting relationship with the respective end portions 46 and 48 respectively of the chamber 22. As such, the head body 20 and the walls defining the respective chambers 22 and 24 together cooperate to define a generally oval shaped interior hollow body cavity 64 located between the chambers 22 and 24. Cavity 64 together with the chambers 22 and 24 defines a center of gravity adjustment envelope as described in more detail below. The head body 20 and walls 50 and 56 of chamber 24 further define a hollow upper interior body cavity 66 located between the chamber 24 and the top elongate edge face 43 of the head 10 (FIGS. 1, 4 and 6). It is understood, of course, that the invention encompasses any other suitable orientation of the two arcuate chambers including an orientation where the top chamber 24 is essentially flipped down from its current orientation about the mid-portion 60 thereof in the direction of the bottom chamber 22 so that the two chambers are positioned in a side-by-side and parallel arcuate relationship.

Figure 9:
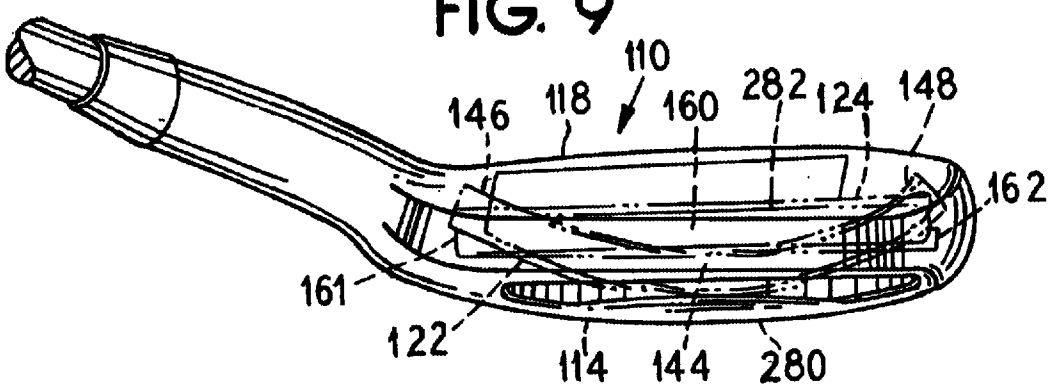
FIG. 9 is a top plan view of the golf club head incorporating an alternate configuration of the ports of the present invention.

Additionally, and referring to FIG. 9 which depicts an alternate head embodiment 110 wherein the lower chamber 122 extends arcuately not only in the longitudinal and transverse "X" and "Y" head axis directions respectively in the same manner as chamber 22 but also arcuately in the back plate to front plate or "Z" axis head direction. Specifically, the chamber 122 is oriented and arched in the back to front head direction in a relationship wherein the chamber mid-portion or segment 144 is spaced from the chamber mid-portion or segment 160 of the upper chamber 124. More specifically, the chamber 122 extends and arches rearwardly away from the chamber end segment 146 thereof in the direction of and into a position generally adjacent the back plate 114 and then arcuately forwardly back into the opposite end segment 148 thereof as the chamber 122 extends arcuately from the heel 126 of the head 110 to the toe 128 of the head 110 in the "X" axis heel to toe direction. The end segments 146 and 148 are located generally adjacent the front strike plate 118 and are positioned generally below and slightly offset from the end segments 161 and 162 of the chamber 124. Rods 280 and 282 are shown positioned within the chambers 122 and 124 respectively.

Referring back to FIG. 6, the cavities 64 and 66 defined in the interior of the head body 20 define interior areas of the head body 26 from which material has been omitted in the manufacturing operation so as to reduce the weight of the head 10. In accordance with the present invention, the weight omitted from these areas has been strategically and proportionally transferred to the weighted rods 80 and 82 of the present invention for the purposes described below in more detail.

In accordance with the present invention, the end portions 46 and 61 of the respective chambers 22 and 24 and the walls defining the same terminate in an interior hosel wall 70 (FIGS. 1, 4 and 5) defined in the interior of the head body 20 and extending generally vertically between the sole plate 42 at the lower end of the head 10 and the top face 43 at the upper end of the head 10 so as to define a pair of generally circular hosel junction openings 72 and 74 therein in communication with the interior of the chambers 22 and 24. Head 10 and body 20 additionally define an interior hollow hosel junction cavity 76 between the wall 70 and the heel 26 of the head 10. An opening 78 defined in the outer face of the heel 26 defines the entry point into hosel junction cavity 76 and chambers 22 and 24. Like the cavities 64 and 66, the cavity 76 also defines an interior area of the head body 26 from which material has been omitted so as to allow the transfer thereof to the weighted rods 80 and 82.

Figure 7:
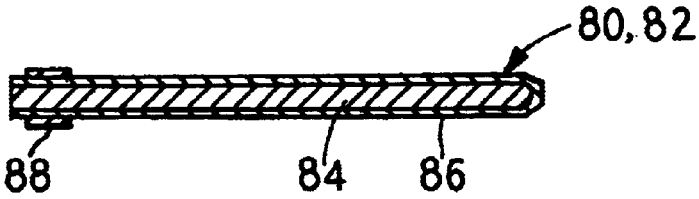
FIG. 7 is a vertical cross-sectional view of one of the weight rods of the present invention.

Still in accordance with the present invention, elongate weighted rods or plugs 80 and 82 are adapted to be inserted into the body 20 of head 10 and fed into chambers 22 and 24 respectively. As shown particularly in FIG. 7, each of the rods 80 and 82 includes a central core 84 which may be made of any suitable flexible and pliable material such as, for example, tungsten, lead, aluminum, brass or lead depending upon the desired weight and C.G. location sought to be achieved. Alternatively, and although not shown, it is understood that the core 84 may also be made of a composite of different materials depending upon the required weight distribution necessary to achieve a desired weight and center of gravity location. Core 84 is surrounded by a protective sleeve 86 made of a plastic or the like pliable and flexible material. Although not shown, it is understood that the sleeve 86 may incorporate outer crushable ribs for guiding the players into the chambers. Sleeve 86, in turn, defines a radial, circumferentially extending shoulder 88 at one end of each of the rods.

Figure 8:
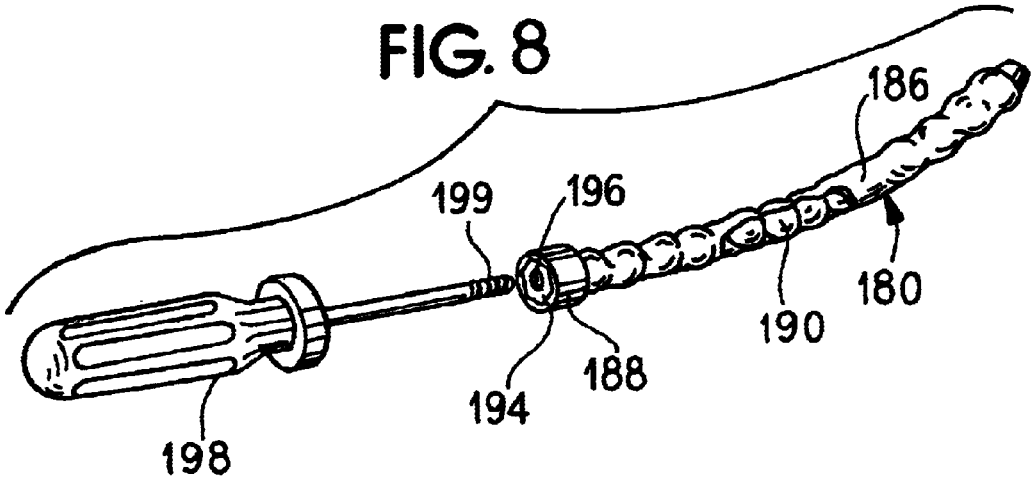
FIG. 8 is a perspective view of an alternate embodiment of the weight rod of the present invention together with the tool adapted for use therewith.

It is understood that the invention encompasses other rod embodiments such as, for example, the rod 180 shown in FIG. 8 which comprises a flexible and pliable sleeve 186 which is closed at one end and adapted to be filled with a plurality of pellets 190 made of the same type of materials as the core 84 of rods 80 and 82. Sleeve 186 forms a radial circumferentially extending shoulder 188 at the open proximal end of rod 180. The open proximal end of the rod additionally defines an interior cavity adapted to receive a generally cylindrical insert 194 having a threaded interior bore 196. Insert 194 is adapted to allow the rod 180 to cooperate with tool 198 for the purposes described hereinbelow in greater detail.

Figure 2:
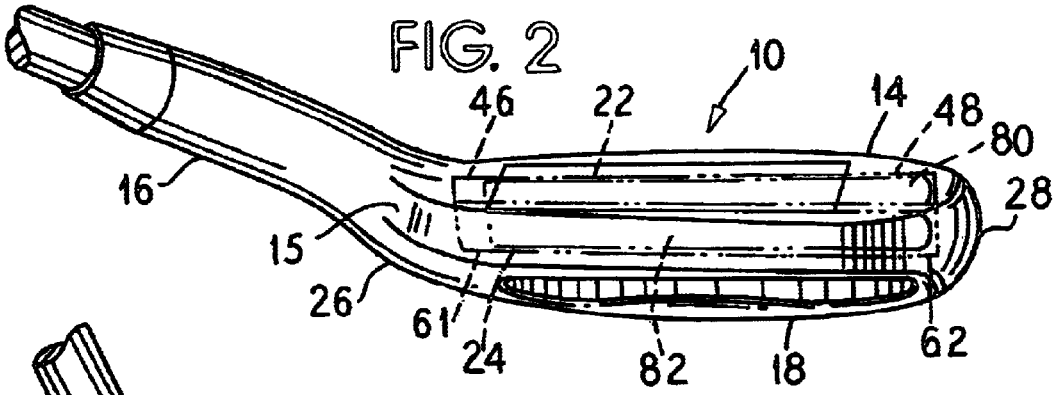
FIG. 2 is a top plan view of the golf club head of FIG. 1.
Figure 3:
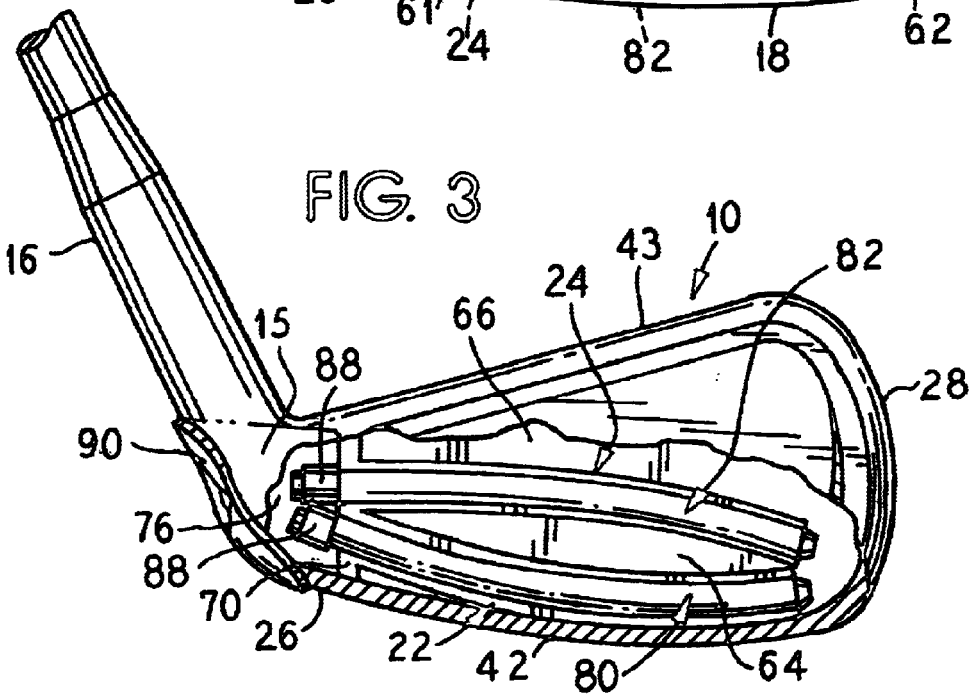
FIG. 3 is an opposite side elevational view of the golf club head of FIG. 1 which also has been broken away to show the interior ports and weight rods of the present invention.
Figure 5:
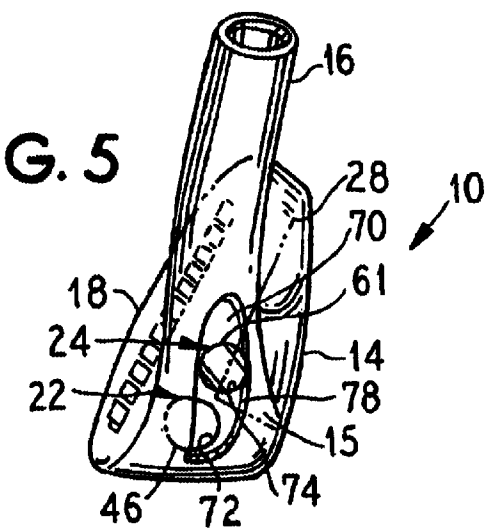
FIG. 5 is a hosel end elevational view of the golf club head of FIG. 1 with the hosel plug removed from the hosel opening.

Referring to FIGS. 4 and 5, rods 80 and 82 are adapted to be fed successively through the opening 78 in heel 26, the hosel junction cavity 76, then respectively through the openings 72 and 74 defined in body interior wall 70 and then through the respective ports 22 and 24 until the shoulder 88 on the respective rods 80 and 82 comes into contact with the peripheral portion of the wall 70 defining the openings 72 and 74 as shown in FIGS. 1–3. In accordance with the present invention, the shoulder 88 on the respective rods 80 and 82 has a diameter greater than both of the ports 22 and 24 and the openings 72 and 74 defined in wall 70 so as to define a limit for the extension of the rods 80 and 82 within the ports 22 and 24.

Moreover, the flexible and pliable nature of the material comprising the rods 80 and 82 advantageously allows the rods to conform to the arcuate configuration of the respective ports 22 and 24 as the rods 80 and 82 are extended therethrough. The pellet structure of the rod 180 shown in FIG. 8 offers the same advantages. While not shown or described therein, it is also understood that the invention encompasses the use of ports having other non-linear configurations other than arcuate to create different C.G. envelopes and further that the pliability of the rods of the present invention will allow the same to conform to the shape of these alternately configured ports.

After both of the rods 80 and 82 have been appropriately positioned within the respective ports 22 and 24, a plug or cover 90 (FIGS. 1 and 4) is adapted to cover the opening 78 in heel 26. Plug 90 may be made from any density material including pliable plastic or rubber depending upon the weight and center of gravity characteristics sought to be achieved. An appropriate sealant or other appropriate welding material may be used to seal or weld the plug 90 in place over the opening if desired.

The removal of rods 80 and 82 from the head 10 requires the removal of the plug 90 from the heel opening 78 and the use of a needle nose pliers or the like tool to grip the rods 80 and 82 about the respective shoulders 88 thereof and then pull the same out of the ports 22 and 24, the cavity 76 and then the opening 78. Alternatively, and in the embodiment of FIG. 8 where the rods incorporate the threaded insert 194, the threaded end 199 of tool 198 may be extended through the opening 78 and through cavity 76, and then threadingly extended into the end 196 of the rod to allow the same to be pulled out of the head 10. Appropriately, the opening 78 and cavity 76 are sized so as to allow the tools described above to be extended therethrough.

In accordance with the present invention, the weight of each of the rods 80 and 82 is dependent upon two factors, i.e., the recommended pre-set final weight of the golf club head 10 and the desired location of the head's center of gravity. In turn, it is well known in the art that the recommended pre-set final weight of the golf club head 10 is itself dependent upon two factors, i.e., the type of club being customized (i.e., the size of iron, driver, wedge or putter being customized) and the length of the golf club shaft. Particularly, it is known in the art that, as the length of the shaft is increased from a standard length, the recommended pre-set final weight of the head decreases from the standard weight and correspondingly that, as the length of the shaft of a golf club is decreased from the standard length, the recommended pre-set final weight of the head increases from the standard weight.

It is also known that the desired or preferred center of gravity location varies from golfer to golfer and is dependent upon several factors including a golfer's preferred ball position, swing angle (i.e., steep or shallow), preferences, and experience (i.e., handicap). It is also known that a consideration of all the above factors will determine the location of the center of gravity, i.e., high, medium or low in the vertical up and down head direction and/or heel, medium or toe in the horizontal side to side head direction.

Due to these numerous variables, the present invention also encompasses a weight and center of gravity tuning package consisting initially of a reference table or the like identification means providing and identifying the recommended final weight of the rods 80 and 82 broken down and summarized according to the type and length of the shaft of the club sought to be customized. The table or the like identification means additionally is adapted to include a breakdown of the suggested or recommended rod combinations required to achieve a particular desired center of gravity location. The weight and center of gravity tuning package also encompasses the use of a box or the like container housing a plurality of weight rods marked by weight and/or other appropriate identification marking.

As an example of the method of using the weight and center of gravity tuning package of the present invention, reference is now made to the steps which would be taken to customize the weight and center of gravity location of a #5 iron golf club. Initially, and assuming for the purposes of this example that the golfer for whom the club is being customized requires a longer (+)0.5" (i.e., ½") shaft length, reference would be made to the table shown in FIG. 10 to identify the weight which the rods would need to be in order to meet the recommended pre-set final weight of the golf club head which, for this example, is about 248 grams.

After having determined the total allowable rod weight for a club requiring the longer ½" shaft length, a desired center of gravity location is identified and determined taking into account the variables identified above. Once a C.G. location has been identified and determined (i.e., high, mid or low), reference would again be made to the table means of FIG. 10 to identify the particular rod or plug combination required to obtain the desired center of gravity location. For example, and assuming that a low C.G. location has been selected, reference to the chart or table would direct an individual to select an 18 gram plug from the plug box with corresponding instructions or identification information to place the 18 gram plug in the lower head chamber 22. In this example, the upper chamber 24 would remain empty. The chart also provides an individual with appropriate identification information directing the individual to reverse the placement of the plug and place the same 18 gram plug into the upper chamber 24 where a high center of gravity is desired. In this example, the lower chamber 22 would remain empty. To achieve a medium or mid center of gravity location, the table provides appropriation identification information to direct an individual to retrieve two plugs of equal 9 gram weight from the plug box and subsequently slide the same into the lower and upper chambers 22 and 24 respectively. The table also provides appropriate rod/plug identification information (i.e., number, weight and appropriate chamber placement information) where either a standard or shorter (−) ½" length shaft is used and a high, mid or low center of gravity is desired.

As a further example in an application where it is desired to shift the center of gravity not only vertically but also side-to-side and back to front in the head, the plug box would additionally include plugs where the weight has been concentrated at one of the respective ends thereof. The table accordingly identifies by number or other appropriate identification indicia the plugs to be selected to achieve the desired center of gravity location. In the example above where both a low and heel center of gravity location is desired for the longer (+) ½" shaft length, the table of FIG. 10 includes appropriate identification information to direct an individual to retrieve a plug from the box weighing 18 grams which has had its weight concentrated towards one end. The rod/plug would, of course, be slid inside the lower chamber 22 in an orientation wherein the concentrated weight end thereof is positioned in the heel of the head. The upper chamber 24 would also remain empty in this example. It is understood that the same rod/plug would simply be reversed or flipped over and slid into the same lower chamber where both a low and toe center of gravity location is desired. The table also provides appropriate identification information on which of the concentrated weight end rods to select and in which of the chambers to slide such rods where either a standard or shorter (−) ½" length shaft is used and a high (heel or toe), mid (heel or toe) or low (heel or toe) center of gravity is desired.

In this embodiment of the tuning package of the present invention which utilizes the chart or rod identification means of FIG. 10, the plug box would include nine plugs where the weight has been evenly distributed (i.e, one each of 18, 24 and 30 gram plugs and two each of 9, 12 and 15 gram plugs) and an additional nine plugs where the weight is concentrated towards one of the ends thereof (i.e., one each of 18, 24 and 30 gram concentrated weight plugs and two each of 9, 12 and 15 gram concentrated weight plugs) for a total of eighteen plugs. Moreover, in accordance with this embodiment, cover 90 may be appropriately colored red, green or blue (or any other selected color) so as to provide a visual identification of whether the club has a high, mid or low center of gravity location. Although not described in any detail, it is understood that the weight concentration in each of the plugs is achieved by using materials with different densities and further that the weight of each of the plugs identified in FIG. 10 may vary depending upon the particular application.

In accordance with the present invention, the spaced-apart and arcuate relationship of the chambers 22 and 24 defined in the head 10 creates an enlarged interior C.G. adjustment envelope encompassing the area bounded and occupied by both of the chambers 22 and 24 and the cavity 64 defined therebetween. Accordingly, the plug box will include plugs weighted and adapted to allow the C.G. to be located at any point along the length of the chambers 22 and 24 as the chambers extend between the heel and toe in the "X" and "Y" directions and/or at any point inside the space or cavity 64 defined therebetween. In the embodiment of FIG. 9, the chamber 122 advantageously creates an enlarged three-dimensional interior C.G. adjustment envelope which allows the C.G. to be adjusted and moved not only in the "X" and "Y" axis head directions as described above but also in the "Z" axis or back to front head direction.

It will be readily apparent from the foregoing detailed description of the invention and from the illustrations thereof that numerous variations and modifications may be effected without departing from the true spirit and scope of the novel concepts or principles of this invention.

I claim:

1. In a golf club head including a body defining a front and a back and a heel and a toe, the improvement comprising at least one elongate hollow port defined in and extending through the body in a relationship wherein the port extends in the front to back direction as the port extends between the heel and the toe, at least one rod of weighed material adapted to be introduced into the body and subsequently positioned in the port for allowing the adjustment of the weight and center of gravity both longitudinally between the heel and toe and transversely between the front and back of the golf club head and a hosel junction, a hosel opening defined in the hosel junction and a cavity defined in the hosel junction, the hosel opening being in communication with the cavity and the cavity being in communication with a port opening defined between the cavity and the port wherein the port opening is smaller than the cavity and whereby the rod is adapted to be introduced into the body and the port successively through the hosel opening, the cavity defined in the hosel junction, and the port opening.

2. The golf club head of claim 1 including first and second ports wherein at least one of the ports is arcuate and further including first and second rods adapted to be positioned in the first and second ports respectively.

3. The golf club head of claim 1 wherein the rod is flexible and adapted to conform to the shape of the port.

4. The golf club head of claim 1 wherein the rod comprises an elongate flexible outer jacket and a central solid core made of a flexible weighted material.

5. The golf club head of claim 1 wherein the rod includes portions made of different materials.

6. The golf club head of claim 1 wherein the rod includes an end adapted to cooperate with a tool adapted to allow the insertion and removal of the rod from the port.

7. The golf club head of claim 1 wherein the end of the rod defines a threaded interior and the tool includes a member adapted to be threaded into the end of the rod.

8. The golf club head of claim 1 wherein the rod includes an end having a shoulder defining a stop limiting the travel of the rod into the port.

9. A golf club head comprising:

a) a club head body including an interior defining a pair of arcuate elongate ports positioned to define a center of gravity adjustment envelope;

b) a hosel junction unitary with the body and defining a hosel junction opening and a hosel junction cavity therein in communication with the interior of the body and the pair of ports defined therein, the pair of ports terminating in a pair of port openings defined in an interior hosel wall defined in the interior of the body between the hosel junction cavity and the pair of ports; and c) a pair of elongate plugs adapted to be introduced through the hosel junction opening and the hosel junction cavity and into the pair of ports respectively through the pair of port openings, the plugs being adapted to conform to the shape of the arcuate ports respectively.

10. The golf club head of claim 9 wherein the first and second plugs comprise elongate flexible jackets filled with weighted material.

11. The golf club head of claim 9 wherein each of the plugs includes an end adapted to cooperate with a tool adapted to allow the insertion and removal of the plugs from the body.

12. The golf club head of claim 9 wherein each of the plugs includes a shoulder adapted to abut against the interior hosel wall and defining a stop limiting the travel of the plugs into the respective ports.

* * * * *

UNITED STATES PATENT AND TRADEMARK OFFICE

CERTIFICATE OF CORRECTION

PATENT NO. : 6,923,734 B2
APPLICATION NO. : 10/423169
DATED : August 2, 2005
INVENTOR(S) : Dean E. Meyer It is certified that error appears in the above-identified patent and that said Letters Patent is hereby corrected as shown below:

Column 2, line 47, change “therewith;” to - - therewith; and - -

Column 2, line 51, change “invention;” to - - invention. - -

Column 2, lines 52-55, delete all

Column 2, line 55, insert - - DETAILED DESCRIPTION OF THE PREFERRED EMBODIMENT - -

Column 6, line 65, delete “(+)0.5”

Column 6, line 65, delete “(i.e., ½”)”

Column 6, line 66, delete “shown in FIG. 10”, insert - - of the tuning package of the present invention - -

Column 6, line 67, change “the” to - - both - -

Column 6, line 67, change “would” to - - will - -

Column 6, line 67, change “be” to - - total - -

Column 7, line 3, change “weight” to - - weight, - -

Signed and Sealed this

Fifth Day of September, 2006

JON W. DUDAS
*Director of the United States Patent and Trademark Office*